US007837529B2

(12) United States Patent
Takada et al.

(10) Patent No.: US 7,837,529 B2
(45) Date of Patent: Nov. 23, 2010

(54) ELECTRON-EMITTING DEVICE AND MANUFACTURING METHOD THEREOF

(75) Inventors: Hiroko Takada, Isehara (JP); Hisanobu Azuma, Hadano (JP); Jun Iba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 12/196,883

(22) Filed: Aug. 22, 2008

(65) Prior Publication Data

US 2009/0058252 A1 Mar. 5, 2009

(30) Foreign Application Priority Data

Aug. 31, 2007 (JP) ..... 2007-224966

(51) Int. Cl.
*H01J 9/24* (2006.01)
*H01J 9/04* (2006.01)

(52) U.S. Cl. ..... 445/24; 445/50; 445/51

(58) Field of Classification Search ..... 313/309–311, 313/495–497

See application file for complete search history.

(56) References Cited

U.S. PATENT DOCUMENTS

| | | | | |
|---|---|---|---|---|
| 6,703,791 | B2 | 3/2004 | Azuma | 315/169.3 |
| 6,972,203 | B2 | 12/2005 | Azuma | 438/20 |
| 6,992,428 | B2 | 1/2006 | Kyogaku et al. | |
| 7,151,005 | B2 | 12/2006 | Azuma | 438/20 |
| 7,381,578 | B2 | 6/2008 | Azuma | 438/20 |
| 7,382,088 | B2 | 6/2008 | Azuma et al. | 313/495 |
| 7,427,826 | B2 | 9/2008 | Iba et al. | 313/236 |
| 7,427,830 | B2 | 9/2008 | Taniguchi et al. | 313/495 |
| 7,507,134 | B2 | 3/2009 | Iba et al. | 445/5 |
| 2003/0124944 | A1 | 7/2003 | Kyogaku et al. | |
| 2006/0087220 | A1 | 4/2006 | Hiroki et al. | 313/495 |
| 2006/0217026 | A1 | 9/2006 | Yoshida | 445/50 |
| 2008/0122336 | A1 | 5/2008 | Nukanobu et al. | 313/310 |
| 2008/0238287 | A1 | 10/2008 | Iba et al. | 313/458 |
| 2008/0238288 | A1 | 10/2008 | Iba et al. | 313/477 R |
| 2008/0309592 | A1 | 12/2008 | Ohashi et al. | 345/75.2 |
| 2009/0072697 | A1 | 3/2009 | Hiroki et al. | 313/326 |

FOREIGN PATENT DOCUMENTS

| | | |
|---|---|---|
| EP | 0 805 472 A1 | 11/1997 |
| EP | 1 302 968 A2 | 4/2003 |
| JP | 64-19655 | 1/1989 |
| JP | 2627620 B2 | 1/1989 |

(Continued)

OTHER PUBLICATIONS

European Search Report completed Oct. 16, 2008 (Appln. Np./Patent No. 08163066.7-2208).

*Primary Examiner*—Bumsuk Won
(74) *Attorney, Agent, or Firm*—Fitzpatrick, Cella, Harper & Scinto

(57) ABSTRACT

A manufacturing method of an electron-emitting device according to the present invention includes the steps of: preparing a substrate having a first electrode and a second electrode, and a conductive film for connecting the first electrode and the second electrode; and forming a gap on the conductive film by applying a voltage between the first electrode and the second electrode; wherein a planar shape of the conductive film has a V-shape portion between the first electrode and the second electrode.

3 Claims, 24 Drawing Sheets

FOREIGN PATENT DOCUMENTS

| | | |
|---|---|---|
| JP | 2002-203475 | 7/2002 |
| JP | 2003-257303 | 9/2003 |
| JP | 2005-190769 | 7/2005 |
| JP | 2005-259645 | 9/2005 |
| JP | 2006-185820 | 7/2006 |
| JP | 2006-216422 | 8/2006 |

FIG3.A
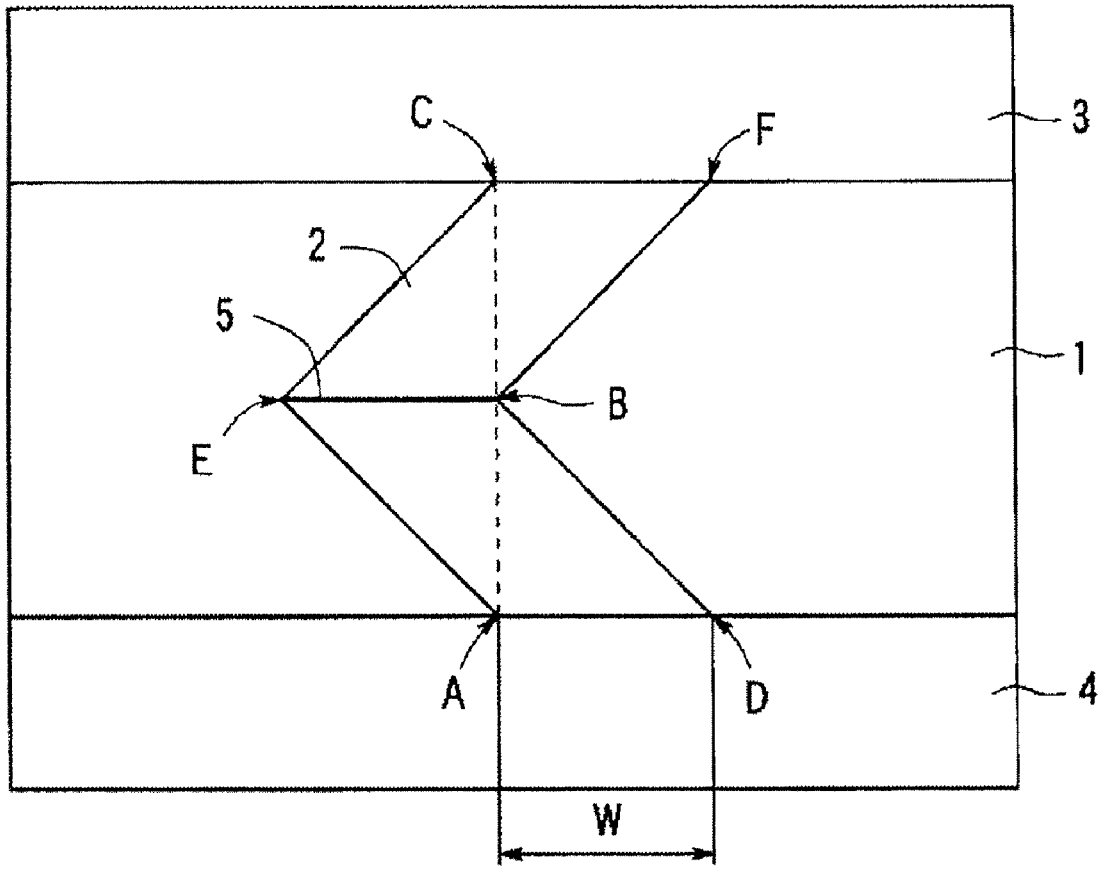

FIG3.B
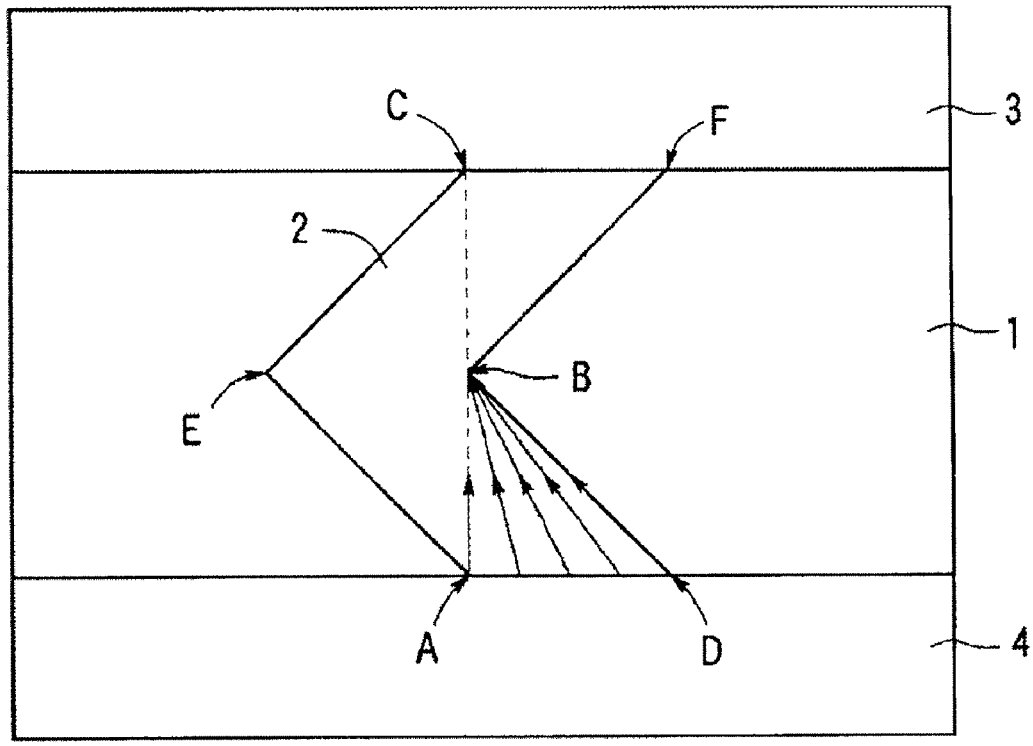

FIG4.A
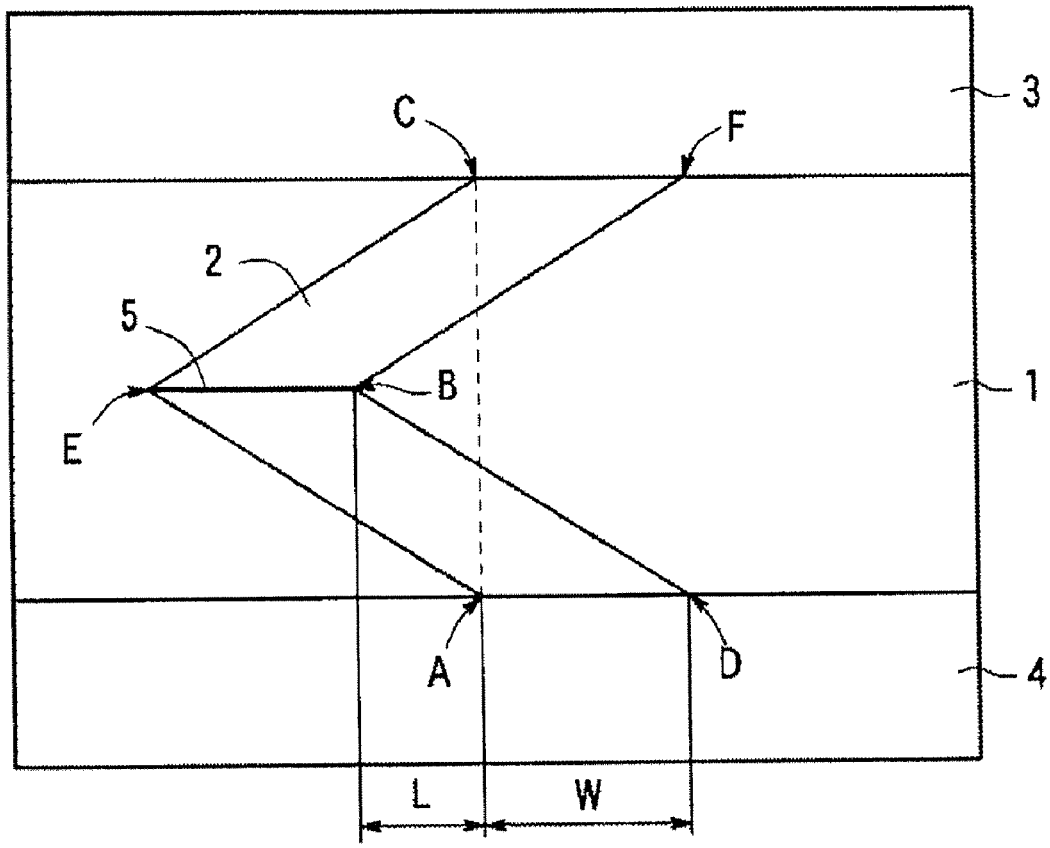

FIG5.A
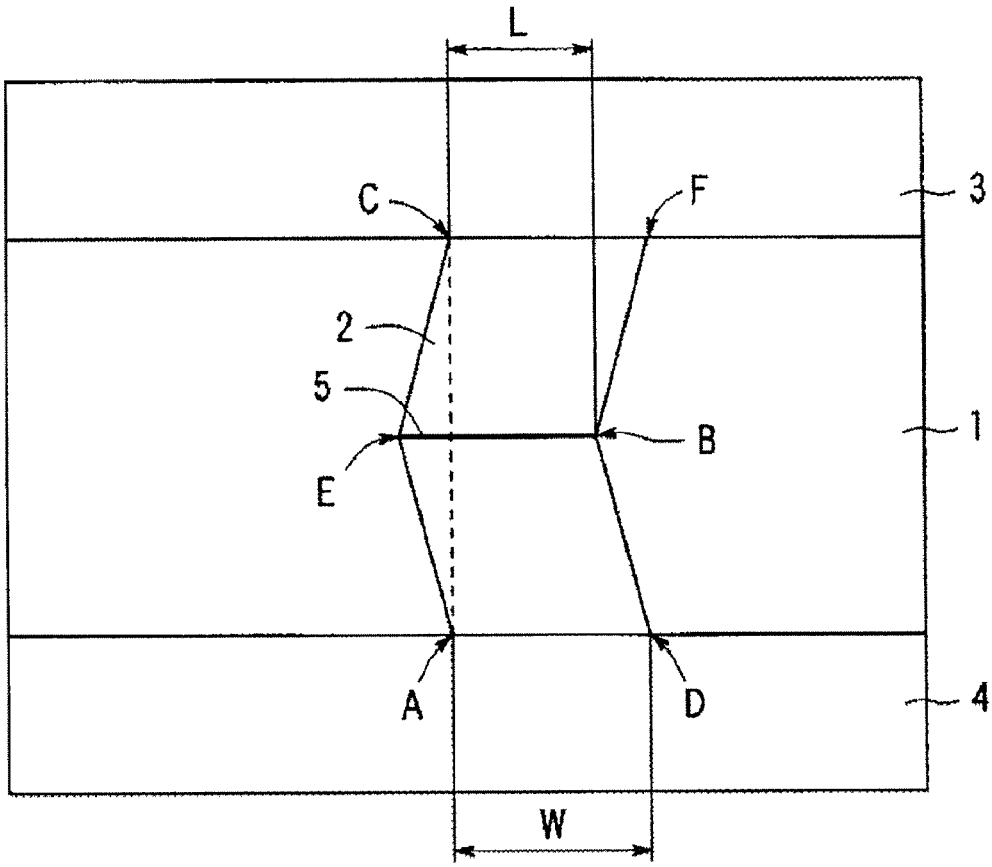

FIG5.B
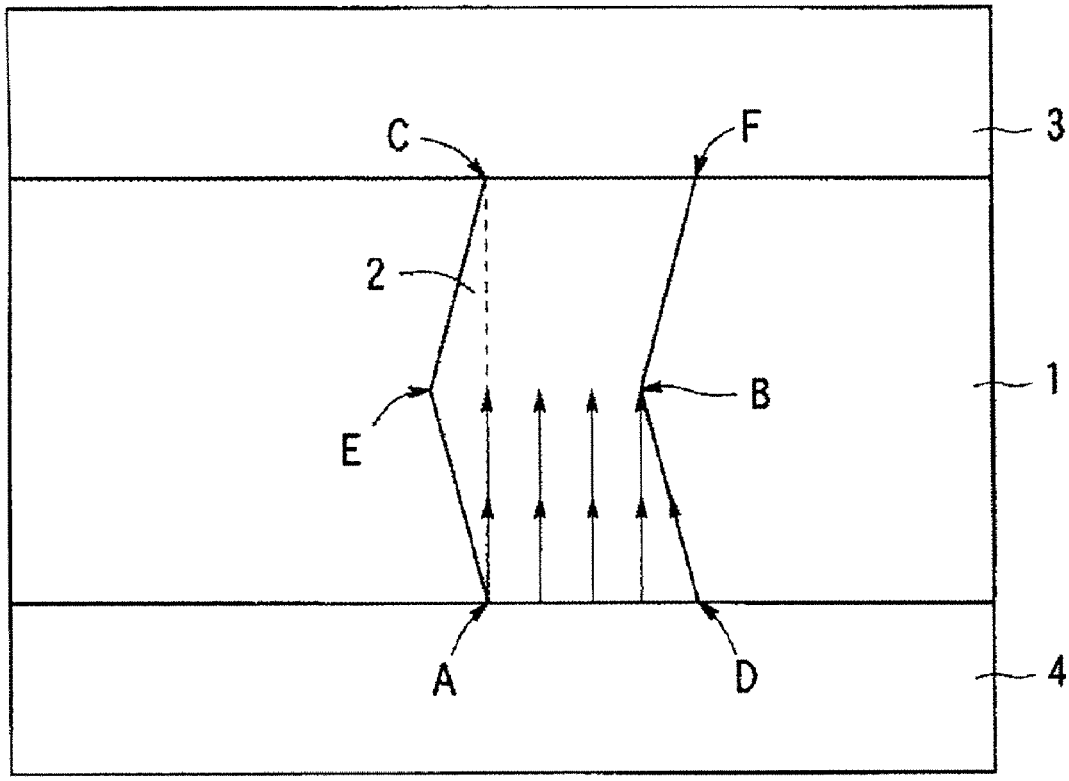

FIG.19

| | NUMBER OF CONDUCTIVE FILMS | SPACE | LENGTH OF GAP | FORMATION POSITION OF GAP | L/W | FORMING POWER |
|---|---|---|---|---|---|---|
| EXAMPLE 1 | ONE PIECE | 10μm | 5μm | ◎ | 0 | 1 |
| | TEN PIECES | 100μm | 50μm | ◎ | 0 | 1 |
| EXAMPLE 2 | ONE PIECE | 13.7μm | 5μm | ○ | -0.73 | 1.23 |
| | TEN PIECES | 103.7μm | 50μm | ○ | -0.73 | 1.23 |
| EXAMPLE 3 | ONE PIECE | 13.7μm | 5μm | ○ | -0.37 | 1.1 |
| | TEN PIECES | 103.7μm | 50μm | ○ | -0.37 | 1.1 |
| EXAMPLE 4 | TEN PIECES | 125μm | 75μm | ○ | 0, 0.5 | 1.21 |
| COMPARATIVE EXAMPLE 1 | ONE PIECE | 5μm | 5μm | × | — | 2 |
| | TEN PIECES | 95μm | 50μm | × | — | 2 |
| COMPARATIVE EXAMPLE 2 | ONE PIECE | 15μm | 5μm | ○ | — | 1.26 |
| | TEN PIECES | 195μm | 50μm | ○ | — | 1.26 |

ELECTRON-EMITTING DEVICE AND MANUFACTURING METHOD THEREOF

BACKGROUND OF THE INVENTION

1. Field of the Invention

The present invention relates to an electron-emitting device that is used for a flat panel display, and a manufacturing method of the electron-emitting device.

2. Description of the Related Art

A surface conduction electron-emitting device utilizes a phenomenon such that electron-emission is generated by applying a current on a film surface of a conductive film of a small area that is formed on a substrate in parallel. It has been popular that an electron emission portion is formed on the conductive film of the surface conduction electron-emitting device in advance by a conducting process (a forming). Specifically, the electron emission portion is formed by applying a direct voltage or a very slow boost voltage (for example, about 1 V/minute) to the opposite ends of the conductive film. Thereby, the conductive film is locally damaged, transformed, or modified, and then, as an electron emission portion, an electrically high resistive part is formed. Further, due to this forming, a gap is formed on a part of the electron emission portion of the conductive film. The electron is emitted from the vicinity of the gap.

In an image display apparatus to be formed by using a plurality of such electron-emitting devices, it is necessary to equalize an electron emission characteristic of the electron-emitting device. For this, an art to form a gap on a predetermined position of the conductive film is required.

In Japanese Patent Application Publication (JP-B) No. 2627620, a method of forming a stenosis portion for focusing a current by removing a part of the conductive film and forming a gap in the stenosis portion is disclosed. In JP-B No. 3647436, a method of forming a gap, by differentiating a width at a connection part of one electrode and the conductive film and a width at a connection part of other electrode and the conductive film, in the vicinity of an electrode on the side of which width at the connection part is shorter is disclosed.

However, according to any of the methods disclosed in JP-B No. 2627620 and JP-B No. 3647436, forming a stenosis portion in the conductive film, then, a gap is formed in the stenosis portion. In such a method, it is hard to elongate the length of the gap because space efficiency is lowered (namely, a space needed for mounting the conductive film is made large).

SUMMARY OF THE INVENTION

An object of the present invention is to provide an electron-emitting device, which can obtain a sufficient electron emission amount by elongating the length of the gap. In addition, the object of the present invention is to control the position of the gap in the conductive film and provide an art for manufacturing an electron-emitting device having a small characteristic variation by low power consumption.

A manufacturing method of an electron-emitting device according to the present invention may include the steps of: preparing a substrate having a first electrode and a second electrode, and a conductive film for connecting the first electrode and the second electrode; and forming a gap on the conductive film by applying a voltage between the first electrode and the second electrode; wherein a planar shape of the conductive film has a V-shape portion between the first electrode and the second electrode.

The manufacturing method of the electron-emitting device according to the present invention may include the following constitutions as preferable aspects.

Opposite sides of the first electrode and the second electrode are parallel with each other, and a width of the conductive film in a direction in parallel with these sides is constant between the first electrode and the second electrode.

Assuming that an inside apex of a bend portion of the V-shape portion is a point B; an outside apex of the bend portion is a point E; an intersecting point of a side of the conductive film including the point E and the first electrode is a point C; an intersecting point of the side of the conductive film including the point E and the second electrode is a point A; a distance between a line segment AC connecting the point A and the point C and the point B is L; and a width of the conductive film at a connection portion with one electrode of the first and second electrodes, which is at a higher potential than the other electrode in the step of forming the gap on the conductive film is W; $|L/W| \leqq 0.8$ is established.

The substrate may include a plurality of conductive films having the V-shape portions, respectively; and the V-shape portions of the plurality of conductive films are bent in the same direction.

An electron-emitting device according to the present invention may include a substrate; a first electrode and a second electrode, which are arranged on the substrate; and a conductive film for connecting the first electrode and the second electrode, which is arranged on the substrate; and wherein a planar shape of the conductive film has a V-shape portion between the first electrode and the second electrode; and the conductive film has a gap on a bend portion of the V-shape portion.

The electron-emitting device according to the present invention may include the following constitutions as preferable aspects.

Opposite sides of the first electrode and the second electrode are parallel with each other, and a width of the conductive film in a direction in parallel with these sides is constant between the first electrode and the second electrode.

The substrate includes a plurality of conductive films having the V-shape portions, respectively; and the V-shape portions of the plurality of conductive films are bent in the same direction.

According to the present invention, the conductive film has a V-shape portion, so that a current is intensively applied to the bend portion of the V-shape portion upon forming. Therefore, a temperature easily rises by low power consumption. Thereby, it is possible to form a gap consistently in the bend portion using little current. In addition, in the case of forming a plurality of conductive films in the electron-emitting device, by bending the conductive films in the same direction, it is possible to efficiently arrange a plurality of conductive films in a narrow space. Therefore, a gap that is longer than the conventional case can be formed. Thereby, a sufficient electron emission amount can be obtained.

Thereby, according to the present invention, it is possible to manufacture an electron-emitting device showing a uniformed and excellent electron emission characteristic with a small space and a high repeatability. In addition, by using such an electron-emitting device, an image display apparatus with a high definition and a high image quality can be provided.

Further features of the present invention will become apparent from the following description of exemplary embodiments with reference to the attached drawings.

BRIEF DESCRIPTION OF THE DRAWINGS

FIG. 3A is a plan pattern view for explaining a preferable shape of the conductive film of the electron-emitting device according to the present embodiment;

FIG. 3B is a plan pattern view for explaining a preferable shape of the conductive film of the electron-emitting device according to the present embodiment;

FIG. 4A is a plan pattern view for explaining a preferable shape of the conductive film of the electron-emitting device according to the present embodiment;

FIG. 5A is a plan pattern view for explaining a preferable shape of the conductive film of the electron-emitting device according to the present embodiment;

FIG. 5B is a plan pattern view for explaining a preferable shape of the conductive film of the electron-emitting device according to the present embodiment;

FIG. 19 is a view showing the configuration of the device and a forming power in each example and each comparative example.

DESCRIPTION OF THE EMBODIMENTS

The present invention relates to a device for forming a gap within a conductive film and emitting an electron from the vicinity of the gap and a manufacturing method of the device. Particularly, it is preferable that the present invention is applied to an electron-emitting device for emitting an electron by supplying a potential difference between a pair of electrodes, for example, a surface conduction electron-emitting device.

As a preferable embodiment of the present invention, an example of the surface conduction electron-emitting device will be specifically described below.

Figure 1A:
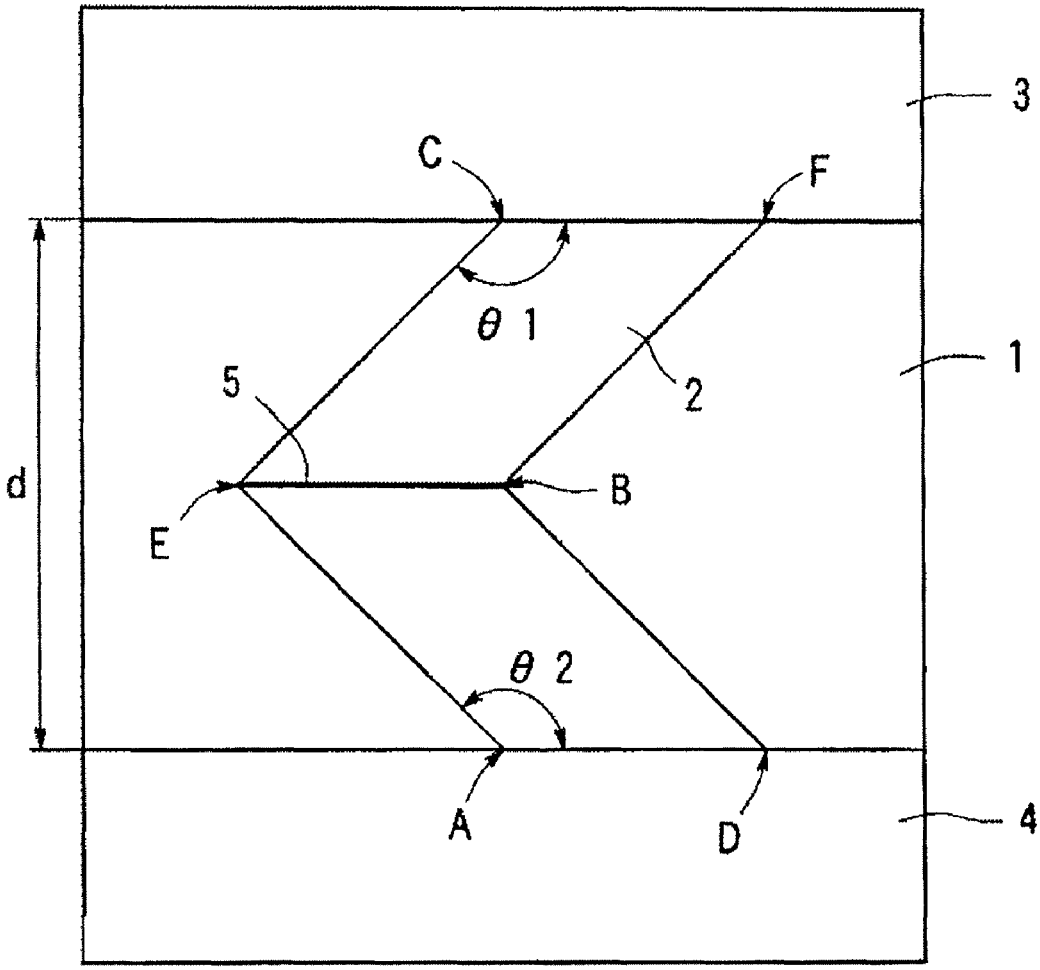
FIG. 1A is a plan pattern view showing an example of a configuration of an electron-emitting device according to the present embodiment.

FIG. 1A is a plan pattern view showing an example of a configuration of an electron-emitting device according to the present embodiment.

As shown in FIG. 1A, the electron-emitting device according to the present embodiment has a pair of electrodes 3 and 4 (a first electrode 3 and a second electrode 4), and a conductive film 2. The electrodes 3 and 4 are mounted on a substrate 1, and they are separated by a gap d. The conductive film 2 is connected to the electrode 3 and the electrode 4, and has a gap 5 on part thereof. Normally, in order to provide good electric connection with the electrode 3 and the electrode 4, and the conductive film 2, the conductive film 2 is mounted so that part thereof overlaps with the electrodes 3 and 4, however, the overlapping portion is omitted in the drawing.

Figure 1B:
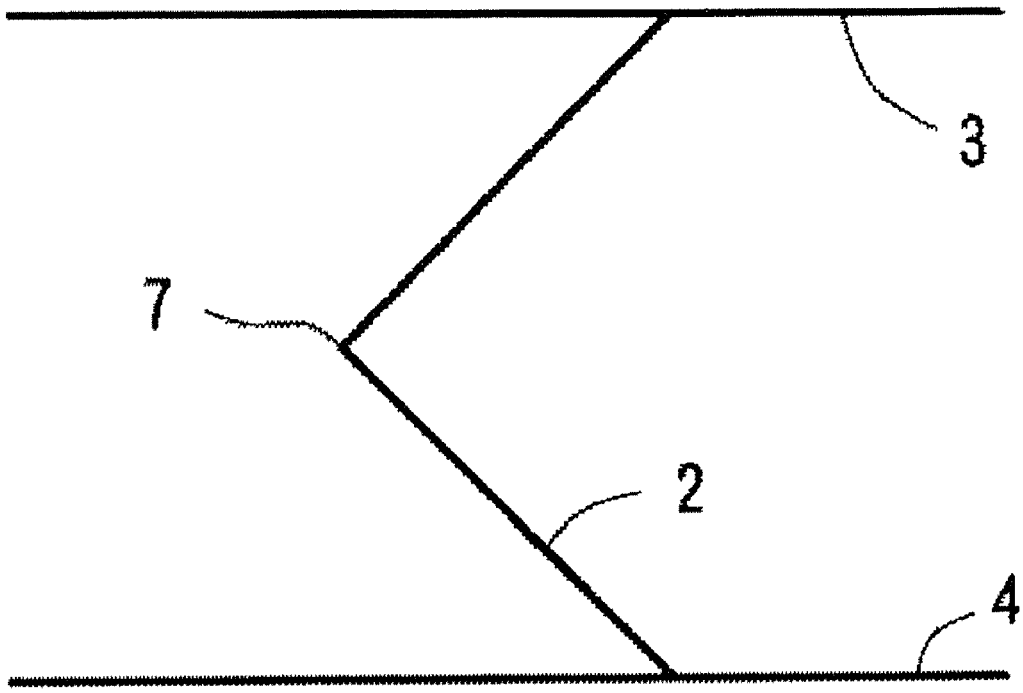
FIG. 1B is a plan pattern view patterning a band-like conductive film in FIG. 1A by a line segment.

FIG. 1B is a plan pattern view patterning a band-like conductive film 2 in FIG. 1A by a line segment. As shown in FIG. 1B, the conductive film 2 according to the present embodiment has a bend portion 7 (a bend) between the electrodes 3 and 4. In other words, the conductive film 2 of the electron-emitting device according to the present embodiment is formed in a belt-like shape and is bent between the electrodes 3 and 4. Specifically, the planar shape of the conductive film 2 has a V-shape portion between the first electrode 3 and the second electrode 4. Such a shape is generally referred to as "a chevron shape".

In the examples shown in FIG. 1A and FIG. 1B, the opposing sides of the electrodes 3 and 4 are parallel with each other. The conductive film 2 has a width in a direction along the opposing sides of the electrodes 3 and 4. In FIG. 1A, the gap 5 is formed in an area connecting a point B and a point E. The point B is an inside apex of the bend portion 7 (of the V-shape portion), and the point E is an outside apex of the bend portion 7 (of the V-shape portion). Further, in the case such that the opposing sides of the electrodes 3 and 4 are not parallel, the conductive film 2 has a width in a direction in parallel with a line segment having the same distance from the both sides. The width of the conductive film 2 is the length of the conductive film 2 in a direction as described above.

An effect due to the shape of the conductive film 2 according to the present embodiment will be described. In FIG. 1A, an intersecting point of the side of the conductive film 2 including the point E and the first electrode 3 is defined to be a point C, and an intersecting point of the side of the conductive film 2 including the point E and the second electrode 4 is defined to be a point A. In addition, an intersecting point of the side of the conductive film 2 including the point B and the first electrode 3 is defined to be a point F, and an intersecting point of the side of the conductive film 2 including the point B and the second electrode 4 is defined to be a point D.

Since the planar shape of the conductive film 2 according to the present embodiment has the V-shape portion, if a voltage is applied between the electrodes 3 and 4, a current passing through the conductive film 2 is concentrated at the point B having a low resistance. As a result, due to a Joule heat, it becomes easy for the temperature of the point B to be locally increased. Thereby, by a small current (a small power consumption), the gap 5 can be formed from the point B as an origin. Since the gap 5 is formed in the bend portion 7 in this time, by controlling the position of the bend portion 7, the position of the gap 5 can be controlled. The electron emission characteristic is lowered, for example, in the case such that the gap 5 is too near to any of the electrodes 3 and 4, and in the case such that the gap 5 largely snakes between the electrode 3 and the electrode 4. Therefore, when manufacturing a plurality of electron-emitting devices, if the position of the gap 5 or the like is different for each device, the electron emission characteristic is different for each device. In the electron-emitting devices according to the present embodiment, the position of the gap 5 can be controlled, so that such a variation of the characteristic can be prevented.

An effect in the case such that one electron-emitting device has a plurality of the conductive films 2 (in the case such that the substrate 1 has a plurality of the conductive films 2 having the V-shape portion) will be described.

Figure 2A:
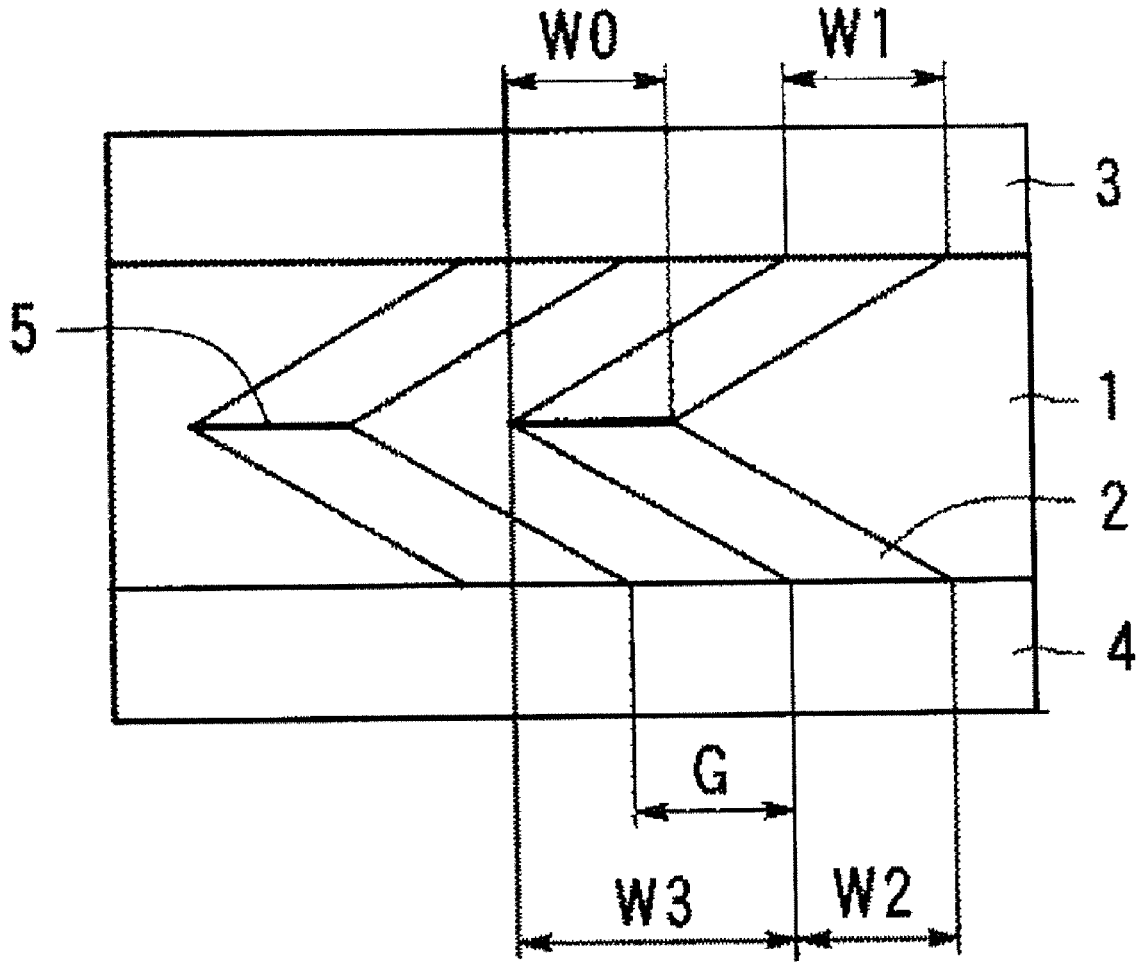
FIG. 2A is a plan view showing an example of the electron-emitting device according to the present embodiment.
Figure 2B:
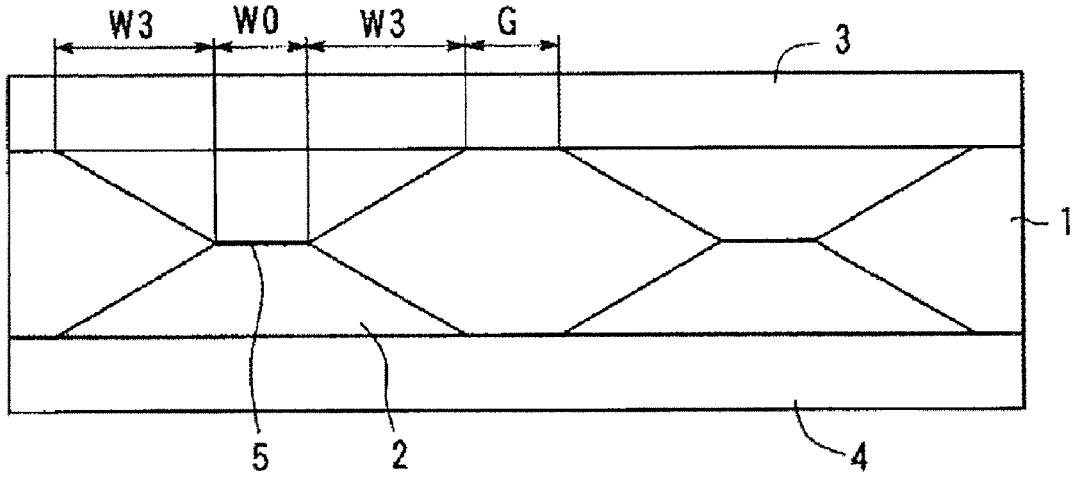
FIG. 2B is a plan view showing a conventional example of an electron-emitting device.

FIG. 2A is a plan view showing an example of an electron-emitting device according to the present embodiment, and FIG. 2B is a plan view showing an electron-emitting device having a stenosis portion, which is disclosed in JP-B No. 2627620. In FIG. 2B, the portion having the narrowest width of the conductive film 2 is defined as a stenosis portion.

FIG. 2A shows an example in the case such that the width of the conductive film 2 in a direction in parallel with opposite sides of the electrode 3 and the electrode 4 is fixed between the electrode 3 and the electrode 4 (line segment CE and line segment FB are parallel with each other and line segment EA and line segment BD are parallel with each other). Accordingly, in FIG. 2A, the width of the conductive film 2 is W0=W1=W2 (W0 is a width at the bend portion, W1 is a width at the connection part with the electrode 3, and W2 is a width at the connection part with the electrode 4). In FIG. 2B, opposite sides of the electrodes 3 and 4 are parallel with each other, and the width of the conductive film 2 is W0 at the stenosis portion and W3×2+W0 at the connection part of the conductive film 2 and the electrode 3 and the connection part of the conductive film 2 and electrode 4. Further, in order to make the explanation simple, the conductive film 2 shown in FIG. 2A is defined to be a vertically-line symmetry using the bend portion as a boundary. The conductive film 2 shown in FIG. 2B is defined to be a vertically-line symmetry using the stenosis portion as a boundary and be a horizontally-line symmetry using the center of the stenosis portion as a boundary. In FIG. 2A and FIG. 2B, the gap between the adjacent conductive films 2 is defined to be G.

In the case such that one piece of the conductive film 2 is provided, a width needed to form the conductive film 2 in FIG. 2A is W0+W3, and a width needed to form the conductive film 2 in FIG. 2B is W0+W3×2. If the length of the gap 5 in FIG. 2A and the length of the gap 5 in FIG. 2B are W0, the conductive film 2 in FIG. 2A can be arranged on an area having a narrower width than that of the conductive film 2 in FIG. 2B by W3 even though the gap 5 thereof has the same length as the conductive film 2 in FIG. 2B.

In the case such that N pieces of the conductive films 2 are provided, a width needed to form the conductive films 2 in FIG. 2A is W3+N×W0+(N−1)×G, and a width needed to form the conductive films 2 in FIG. 2B is N×(W0+W3×2)+(N−1)×G. Accordingly, the conductive film 2 according to the present embodiment can be arranged on an area having a narrower width than that of the conductive film 2 in FIG. 2B by (2N−1)×W3.

Particularly, if opposite sides of the electrodes 3 and 4 contacting the conductive film 2 are parallel, and the width of the conductive film 2 in a direction in parallel with these sides is constant (FIG. 1A, FIG. 2A), it is possible to arrange the conductive film 2 in the narrower area without waste. As described above, a desired electron emission amount of the electron-emitting device according to the present embodiment can be obtained in the area, which is narrower than the conventional electron-emitting device.

Next, by using FIGS. 3A to 5B, a preferable shape of the conductive film 2 according to the present embodiment will be described. A distance between a line segment AC connecting the points A and C of the conductive film 2 according to the present embodiment and the point B is defined to be L, and in a step for forming the gap 5 in the conductive film 2, the width of the conductive film 2 (the length of the line segment AD) in the connection portion with the electrode being a high potential (according to the present embodiment, defined to be the second electrode 4) is defined to be W. According to the example shown in FIG. 3A and FIG. 3B, L=0 is established, and according to the example shown in FIGS. 4A to 5B, L≠0 is established. FIG. 4 shows the case such that the line segment AC intersects with the line segment BD (a line segment BF). In this case, it is assumed that L<0 is established. FIG. 5 is a view showing the case such that the line segment AC does not intersect with a line segment BD (the line segment BF). In this case, it is assumed that L>0 is established.

According to the present embodiment, it is preferable that $|L/W| \leqq 0.8$ because the smaller L is the more the current supplied from the electrode 3 or 4 is concentrated to the inside of the bend portion 7. Thereby, a temperature is easily increased, and by a less energy, the gap 5 can be formed.

Figure 4B:
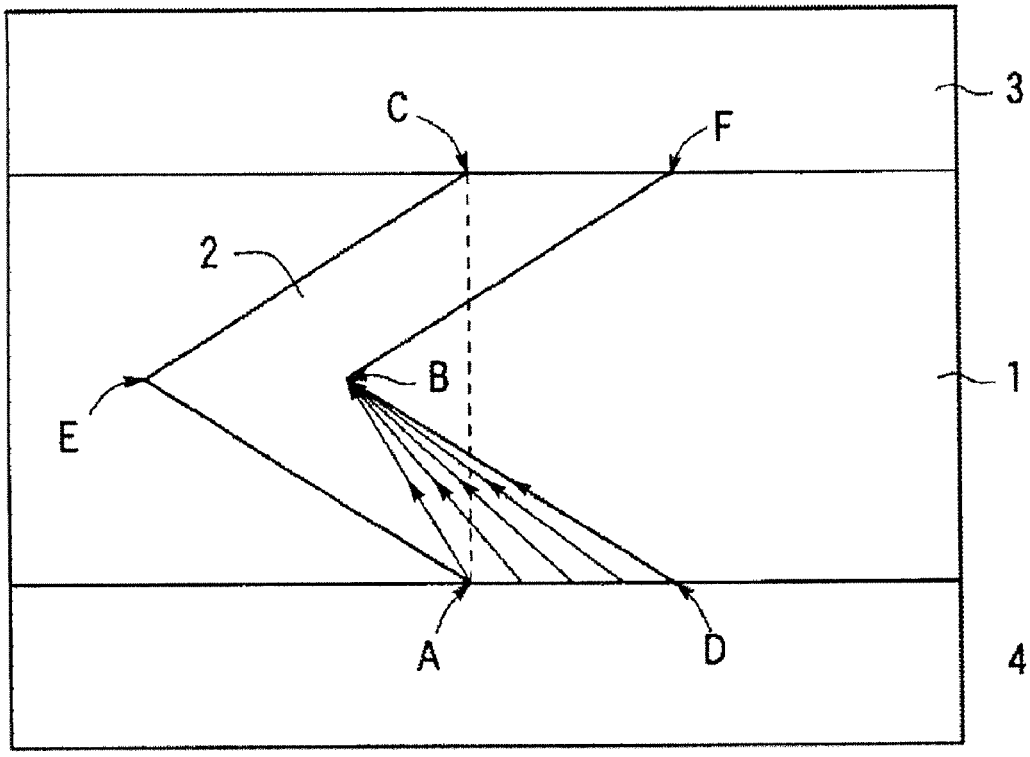
FIG. 4B is a plan pattern view for explaining a preferable shape of the conductive film of the electron-emitting device according to the present embodiment.

Each of FIG. 3B, FIG. 4B, and FIG. 5B illustrates a main flow of a current passing through the conductive film 2 from the second electrode 4 by a straight line arrow as a pattern view in a forming step for forming the gap 5 in the conductive film 2 shown in FIG. 3A, FIG. 4A, and FIG. 5A, respectively. In FIG. 3B, FIG. 4B, and FIG. 5B, the higher a density of the arrows is, the higher a density of a current is.

Comparing FIG. 3B to FIG. 5B, it is known that the current is more concentrated on the inner point B of the bend portion in the case of L=0 (the configuration shown in FIG. 3B) than in the case of L>0 (the configuration shown in FIG. 5B).

In FIG. 3B and FIG. 4B, any of the current passing through the conductive film 2 from the electrode 4 is concentrated on the point B (in the vicinity of the point B, the density of the current is increased). However, the configuration shown in FIG. 4B is slightly disadvantageous from the point of view of concentration of a power density (the temperature in the vicinity of the point B is hardly increased because the area where the current density is concentrated becomes large). In addition, comparing FIG. 3B to FIG. 5B, it is clear that the current density at the point B in FIG. 5B is smaller than that in FIG. 3B. Thereby, comparing FIGS. 3A to 5B, it is known that the temperature of the conductive film 2 shown in FIG. 3A (FIG. 3B) is easily increased and this is more preferable configuration. As being known from FIGS. 3A to 5B, the current density in the vicinity of the point B is defined by L and W. According to the consideration of the inventors, if $|L/W| \leqq 0.8$ is established, it is possible to obtain a higher power consumption decrease effect than the conventional art.

Figure 18:
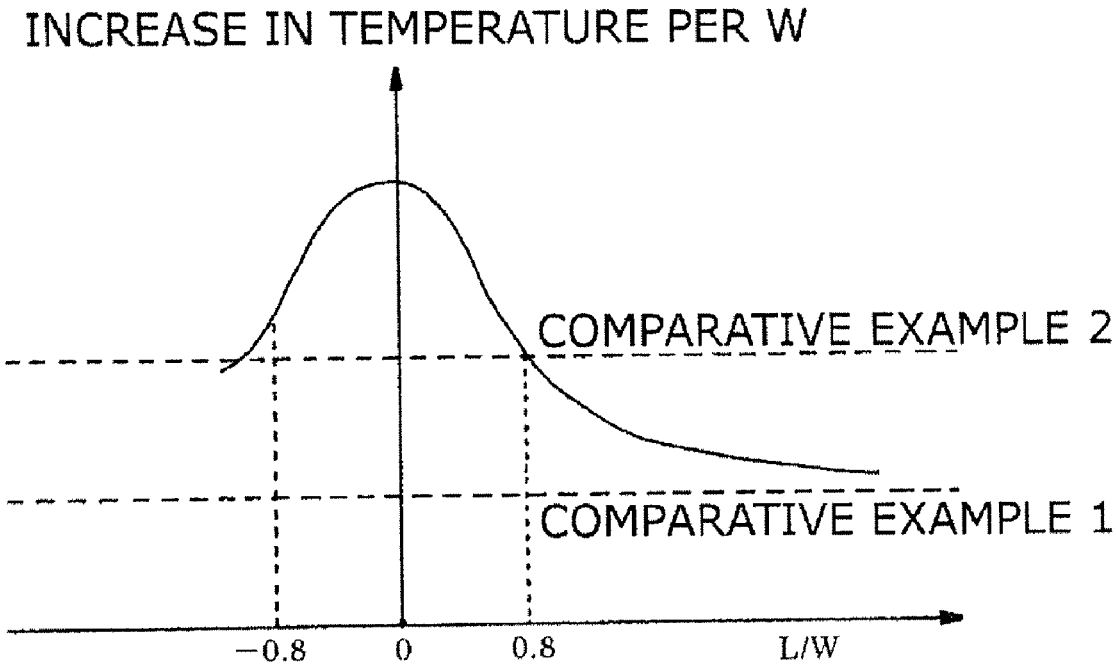
FIG. 18 is a view showing increase of temperature per 1 [W (watt)] for L/W upon forming of the electron-emitting device according to the present embodiment.

FIG. 18 is a view showing increase of temperature per 1 [W] for L/W upon forming of the gap 5 in the electron-emitting device according to the example of the present invention to be described later. As shown in FIG. 18, in the case of L/W=0 (FIG. 3A), increase of the temperature per 1 [W] becomes the highest value. Therefore, in the case of L/W=0 (FIG. 3A), the gap 5 can be formed at the lowest power consumption. In the case of L/W<0 (FIG. 4A), the current density becomes even in a wider range than the case of L/W=0, so that the temperature is dispersed. Therefore, increase of the temperature per 1 [W] becomes small. In the case of L/W>0 (FIG. 5A), as compared to L1/W=0, the current passes other than the vicinity of the point B, so that the current density in the vicinity of the point B becomes small. Therefore, increase of the temperature per 1 [W] becomes small. In the electron-emitting device according to the example of the present invention, comparing a temperature increase value per 1 [W] when forming the gap 5 in the conductive film 2 to a temperature increase value in a comparative example 2 to be described later (a temperature increase value per 1 [W] when forming the gap 5 in the conventional conductive film 2 having the stenosis portion shown in FIG. 2A), it is known that the gap 5 can be formed in the electron-emitting device according to the example of the present invention with a power consumption, which is equal to or lower than the conventional configuration, in the case of $|L/W| \leqq 0.8$.

Further, if the planar shape of the conductive film 2 has the V-shape portion between the electrode 3 and the electrode 4, the posture of the bend portion 5 is not limited, and the above-described effect can be obtained.

Next, other configuration example of the electron-emitting device according to the present embodiment will be described.

Figure 6:
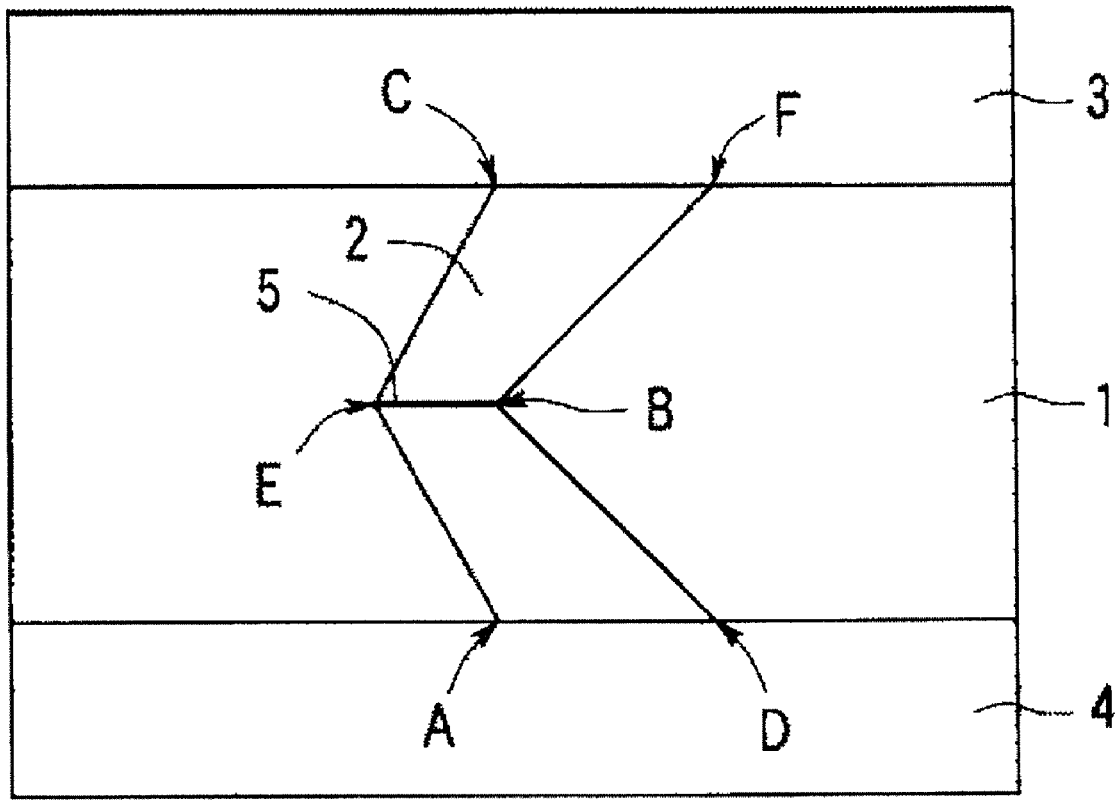
FIG. 6 is a plan pattern view showing an example of a configuration of the electron-emitting device according to the present embodiment.

FIG. 6 shows the example of the case such that the width of the conductive film 2 at the connection portion of the conductive film 2 and the electrode 3 and the connection portion of the conductive film 2 and the electrode 4 is wider than the width at the bend portion 7 (EB<AD, EB<CF). In other words, the width at the bend portion 7 becomes the narrowest in the conductive film 2. Thereby, more current is concentrated on the point B, and the gap 5 can be easily formed from the position of the point B as an origin.

Figure 7:
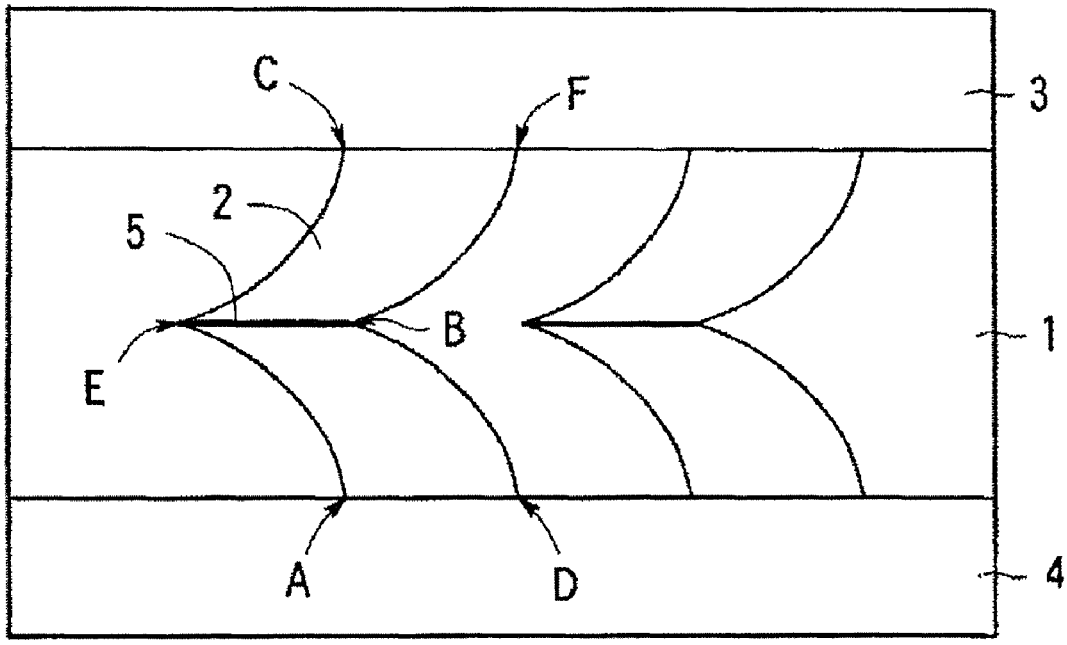
FIG. 7 is a plan pattern view showing an example of a configuration of the electron-emitting device according to the present embodiment.
Figure 8:
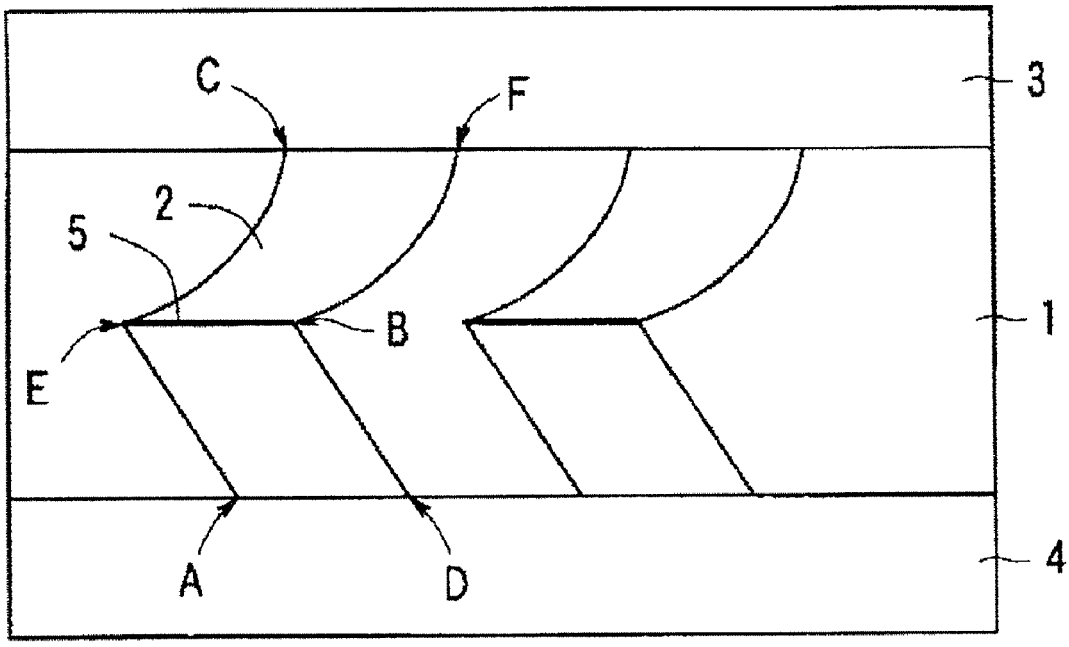
FIG. 8 is a plan pattern view showing an example of a configuration of the electron-emitting device according to the present embodiment.

FIG. 7 shows the example of the case such that the sides CE, EA, FB, and BD of the conductive film 2 are curved lines. Also in such a configuration, the same effect as the configuration shown in FIG. 1 can be obtained. In addition, as shown in FIG. 8, the same applies to the case such that the sides CE and FB on one side are curved lines and the sides EA and BD on the other side are straight lines using the bend portion as a boundary.

Figure 9:
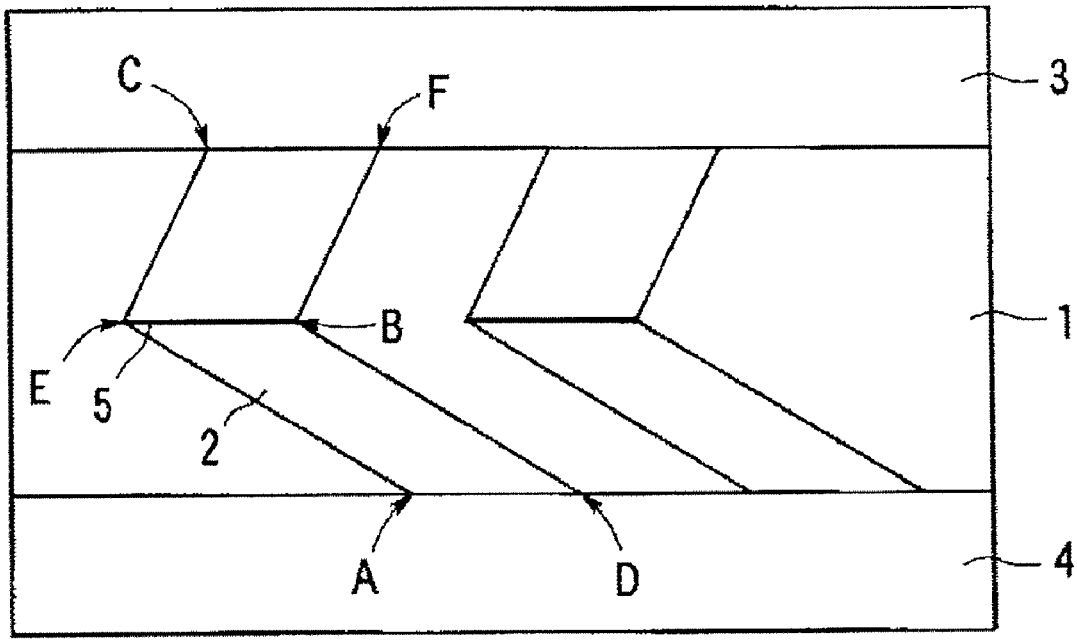
FIG. 9 is a plan pattern view showing an example of a configuration of the electron-emitting device according to the present embodiment.

In addition, the angle to be formed by connecting the conductive film 2 and the first electrode 3 and the angle to be formed by connecting the conductive film 2 and the second electrode 4 (∠FCE and ∠EAD (∠BFC and ∠ADB) may be different from each other as shown in FIG. 9 (in FIG. 1A, $\theta 1 \neq \theta 2$ may be possible). Also in this configuration, the same effect as the above-described configuration can be obtained in decrease of a power consumption and control of the position of the gap 5. However, a space needed for forming the conductive film 2 is larger than the case of $\theta 1 = \theta 2$ (a space reduction effect is lowered).

Figure 10:
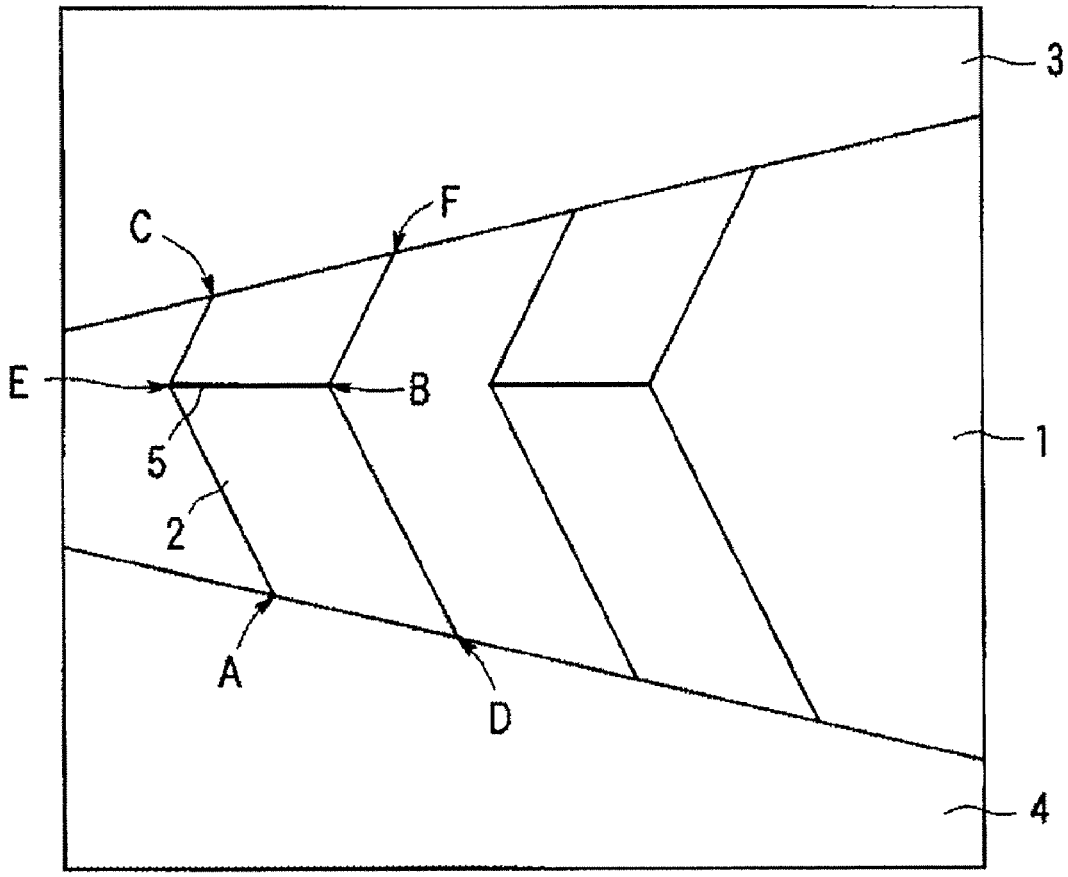
FIG. 10 is a plan pattern view showing an example of a configuration of the electron-emitting device according to the present embodiment.

In addition, as shown in FIG. 10, opposite sides of the electrodes 3 and 4 may not be parallel with each other. In such a configuration, as compared to the case such that opposite sides of the electrodes 3 and 4 are parallel, the same effect can be obtained in decrease of a power consumption and reduction of a space. However, the effect in control of the position of the gap 5 is lowered than the case such that opposite sides of the electrodes 3 and 4 are parallel with each other.

Figure 11:
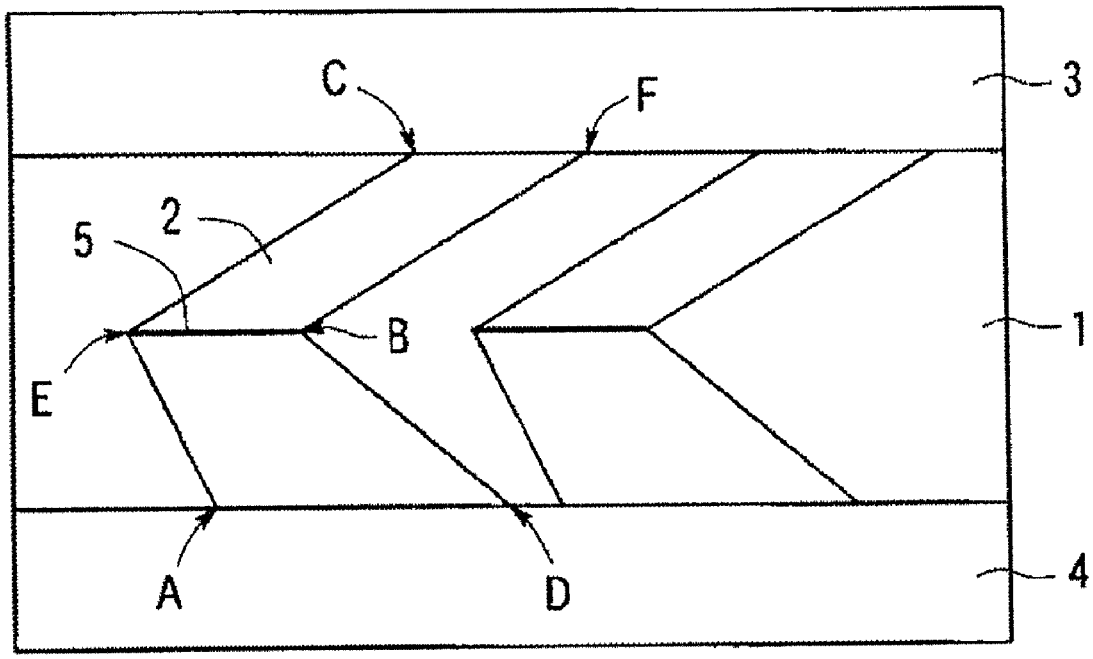
FIG. 11 is a plan pattern view showing an example of a configuration of the electron-emitting device according to the present embodiment.

FIG. 11 shows an example of the case such that the width of the conductive film 2 is not uniformed partially (the case such that the width is changed from the bend portion 7 to one side (for example, the side AD)). In such a configuration, as compared to the case such that the width of the conductive film 2 is uniformed, the same effect can be obtained in decrease of a power consumption and control of the position of the gap. However, the space reduction effect is lowered than the case such that the width of the conductive film 2 is uniformed.

Figure 12:
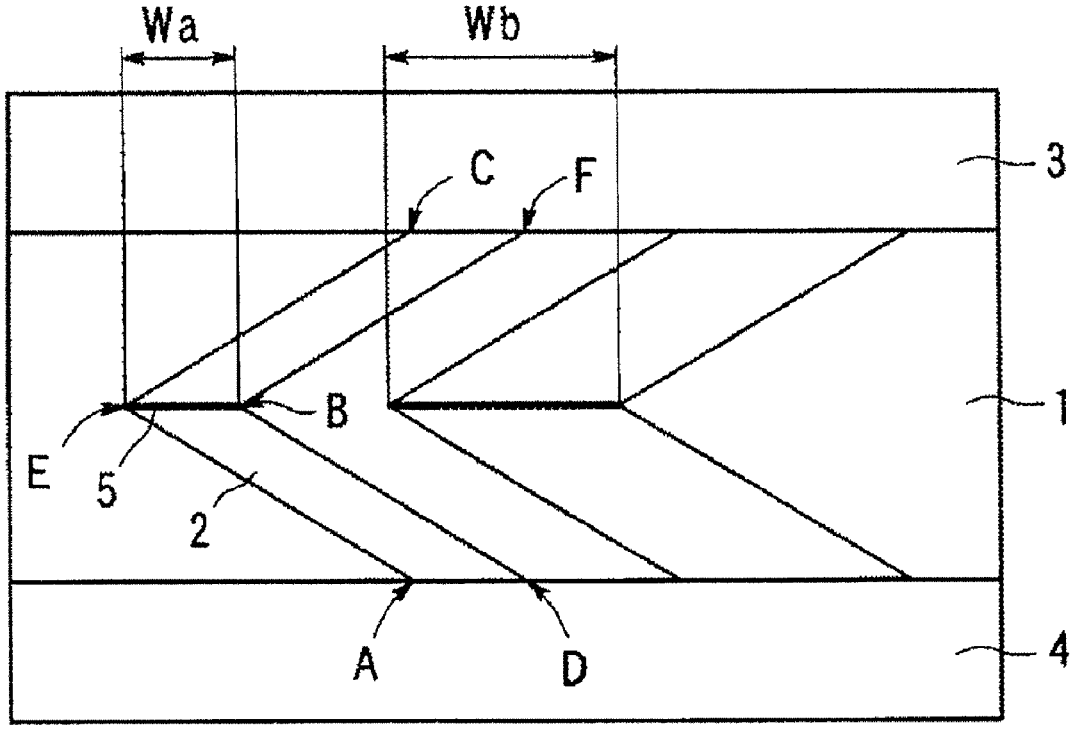
FIG. 12 is a plan pattern view showing an example of a configuration of the electron-emitting device according to the present embodiment.

FIG. 12 shows an example of the case such that the device has a plurality of the conductive films 2 and the widths of them are not the same each other. In such a configuration, as compared to the case such that the widths of them are the same with each other, the same effect can be obtained in decrease of power consumption. However, the effect in control of the position of the gap 5 is lowered than the case such that the widths of a plurality of conductive films 2 are the same with each other.

Figure 13:
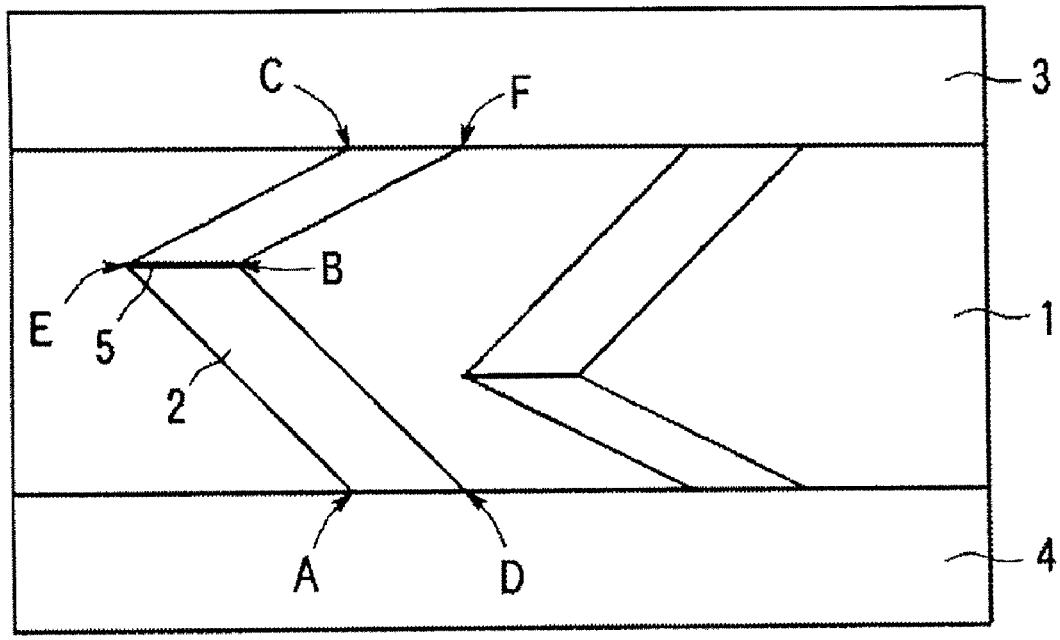
FIG. 13 is a plan pattern view showing an example of a configuration of the electron-emitting device according to the present embodiment.

FIG. 13 shows an example of the case such that the device has a plurality of the conductive films 2 and the distances from the bend portion to the electrodes 3 and 4 are different for each conductive film 2. In such a configuration, as compared to the case such that the distances from the bend portion to the electrodes 3 and 4 are the same for each conductive film 2, the same effect can be obtained in decrease of a power consumption and control of the position of the gap 5. However, the space reduction effect is lowered than the case such that the distances from the bend portion to the electrodes 3 and 4 are the same for each conductive film 2.

Further, the points A, C, D, and F at the connection portions with the electrodes 3 and 4 of the conductive film 2, and the points E and B of the bend portion 7 may have a curvature within a range, which does not damage the above-described effects.

The shape of the conductive film 2 according to the present embodiment can be designed by estimating increase of a temperature by using an interaction analysis with a current passing through the conductive film 2 and a heat transfer through the conductive film 2. Specifically, a temperature of each position is derived by using an electric property value (a conductivity), a thermal property value (a thermal conductivity, a specific heat, and a density), a shape model, and a current value to be supplied to the conductive film 2 (or a voltage value to be applied to the conductive film 2) of the conductive film 2 and the substrate 1 in a finite element solver to couple a current field and a thermal analysis. Then, a condition that a temperature exceeds a fusing point of the conductive film 2 at a certain position is assumed to be a condition (a threshold) that the gap 5 is formed on that position.

A material of each constructional element of an electron-emitting device according to the present embodiment will be described.

As the substrate 1, a glass (a quartz glass, a glass having a contained amount of an impurity such as Na reduced, and a soda lime glass) can be used. In addition, as the substrate 1, a substrate having a $SiO_2$ film layered on the glass substrate by a spattering method or the like, a ceramics substrate such as alumina, and a Si substrate or the like may be used.

As a material of the electrodes 3 and 4, a common conductive material can be used. For example, as the material of the electrodes 3 and 4, a metal such as Ni, Cr, Au, Mo, W, Pt, Ti, Al, Cu, and Pd can be used. In addition, it is preferable that a film thickness of the electrodes 3 and 4 is not less than 1 nm and not more than 1 μm.

As a material of the conductive film 2, for example, a metal such as Pd, Pt, Ru, Ag, Au, Ti, In, Cu, Cr, Fe, Zn, Sn, Ta, W, and Pb and an oxide conductive material such as PdO, $SnO_2$, $In_2O_3$, PbO, and $Sb_2O_3$ can be used. In addition, a nitride such as TiN, ZrN, and HfN can be also used.

In order to obtain an excellent electron emission characteristic, as conductive film 2, a fine particle film composed of fine particles is preferably used. It is preferable that the film thickness is not less than 10 Å (1 nm) and not more than 100 nm. It is preferable that the width of the conductive film 2 is not less than 1 μm and not more than 100 μm.

The gap 5 is a high resistive portion, which is formed on part of the conductive film 2, and a shape of the gap 5 or the like depends on a film thickness, a film quality, and a material of the conductive film 2 and a method of a forming to be described later or the like. In addition, on the surface of the gap 5 and on the conductive film 2 in the vicinity of the gap 5, a carbon film may be provided by a conventionally known method, which is referred to as an activation step (the activation processing).

Next, an example of a manufacturing method of an electron-emitting device according to the present embodiment will be described.

At first, a constituent material of the electrodes 3 and 4 according to a vacuum deposition method is formed on the substrate 1. By patterning the material made into a film by using a photolithography art, the electrodes 3 and 4 are formed.

Next, by applying an organometallic solution on the substrate 1, on which the electrodes 3 and 4 are mounted, an organometallic film is formed. As an organometallic solution, a solution of an organic compound that is mainly composed of the material of the conductive film 2 can be used. Then, this organometallic film is burned. The burned organometallic film is patterned by a liftoff, an etching, and a laser beam machining or the like. Thereby, the conductive film 2 is formed. Further, as a method of forming the conductive film 2, a vacuum deposition method, a spattering method, a chemical vapor deposit method, a distributed application method, a dipping method, and a spinner method or the like can be used.

Then, the gap 5 is formed on each conductive film 2 (the forming processing). The forming processing is processing to form the gap 5 by providing a potential difference to a pair of electrodes 3 and 4 and applying a current to the conductive film 2 (pass a current).

Specifically, by applying a voltage between the electrodes 3 and 4, a Joule heat is generated within the conductive film 2, and thereby, the gap 5 is formed on the conductive film 2. In the forming processing, the voltage to be applied to the electrodes 3 and 4 is preferably a pulse voltage (a pulse waveform). The forming processing may be carried out till a resistance of the conductive film 2 becomes more than 1 [MΩ], for example. The resistance of the conductive film 2 may be computed by measuring a current to be applied when applying a voltage about 0.1 [V], for example.

According to the present embodiment, the gap 5 is formed on the bend portion 7 of the conductive film 2 by this step.

As described above, it is preferable that the activation processing is applied to the electron-emitting device after the forming processing. The activation processing is processing to apply a pulse voltage between the electrodes 3 and 4 as well as the forming processing under an atmosphere containing a gas of an organic material. By this activation processing, a device current If and an emission current Ie to be described later are remarkably increased. Then, due to the activation processing, a carbon film is formed on the surface of the gap 5 and the conductive film 2 in the vicinity of the gap 5. By forming the carbon film on the surface of the gap 5, the width of the gap 5 becomes narrower. Therefore, the electron is emitted from this narrow gap.

Further, it is preferable that stabilization processing is provided to the electron-emitting device, which is obtained through the above-described processing steps. This stabilization processing is processing to reduce an unnecessary substance such as an organic material by exhausting an interior portion of a vacuum apparatus.

Figure 14:
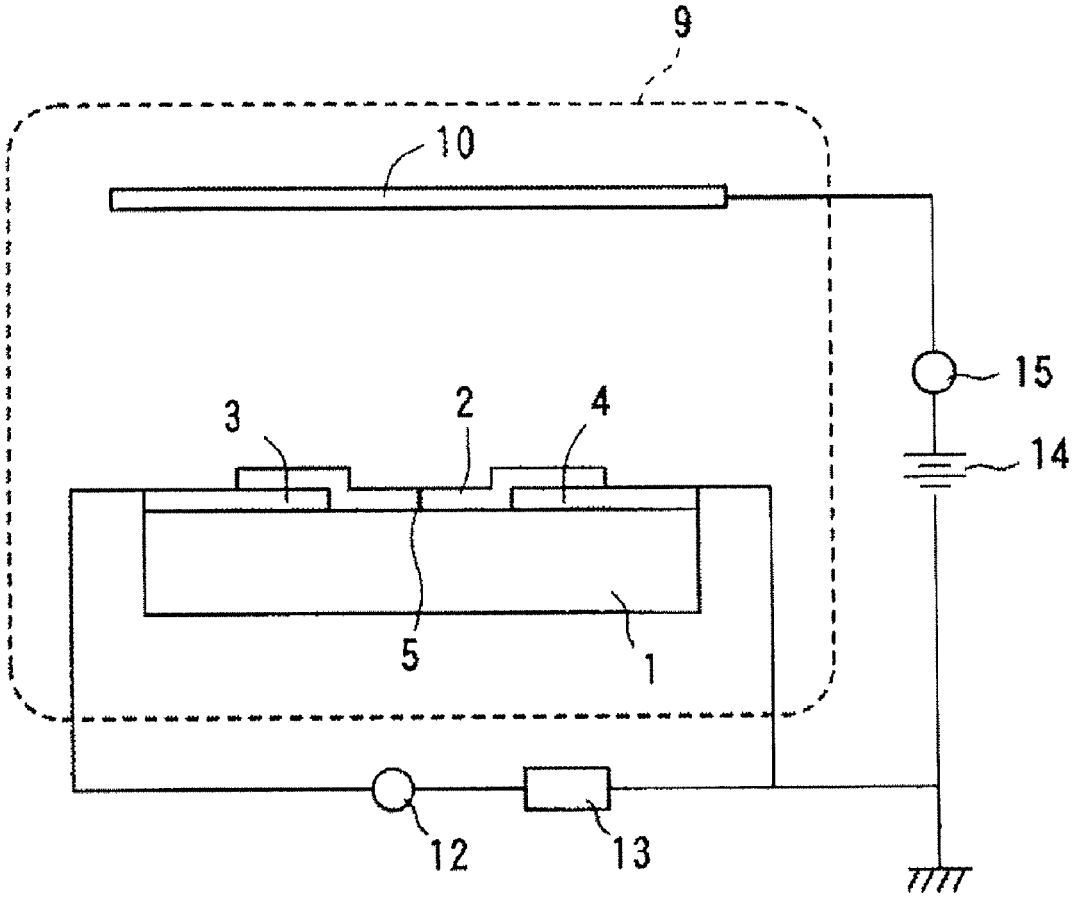
FIG. 14 is a conceptual illustration of a characteristic evaluation apparatus of the electron-emitting device according to the present embodiment.

Next, a basic characteristic of an electron-emitting device manufactured through the above-described processing steps (an electron-emitting device having the substrate 1, the conductive film 2, the electrode 3, 4, and the gap 5) will be described with reference to FIG. 14 and FIG. 15. FIG. 14 is a conceptual illustration of a characteristic evaluation apparatus in order to evaluate a characteristic of an electron-emitting device, and FIG. 15 is a view showing an example of evaluation results.

As shown in FIG. 14, the characteristic evaluation apparatus has a vacuum container 9 for setting an electron-emitting device, which is an object of evaluation. The interior portion of the vacuum container 9 is maintained in a state that the organic material is sufficiently exhausted. In addition, within the vacuum container 9, an anode electrode 10 opposed to the electron emitting surface of the electron-emitting device is mounted.

Between the electrodes 3 and 4 of the electron-emitting device, a pulse voltage is applied by a power source 12. The current If (the device current If) passing between the electrodes 3 and 4 by applying a pulse current is measured by a current meter 13. An anode voltage that is not less than 1 [kV] and not more than 40 [kV] is applied to the anode electrode 10 by the power source 14. The electron emitted from the electron-emitting device crushes into the anode electrode 10, then, passes through the anode electrode 10. Therefore, the amount of the electrons to pass through the anode electrode 10 can be regarded as the amount of the electrons (the electron emission amount) emitted from the electron-emitting device. According to the present embodiment, the current Ie (the emission current Ie) to pass through the anode electrode 10 is measured by a current meter 15.

Figure 15:
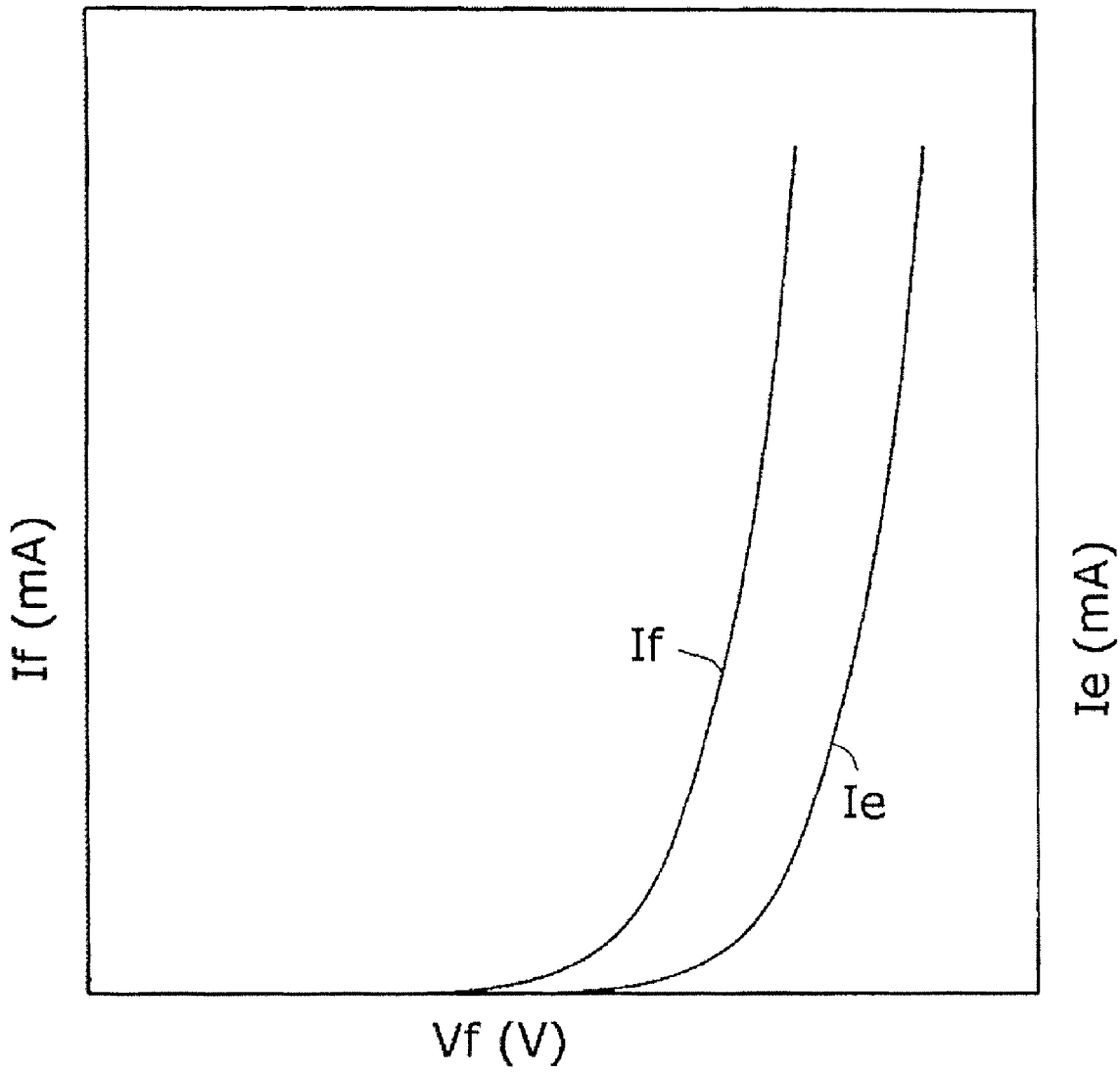
FIG. 15 is a view paternally showing a device characteristic of the electron-emitting device according to the present embodiment.

FIG. 15 is a view paternally showing a device characteristic of the electron-emitting device, which is evaluated by this characteristic evaluation apparatus. As shown in FIG. 15, the device current If, the emission current Ie, and the device voltage Vf may follow a relation of Fowler-Nordheim as an electron emission characteristic.

By arranging many electron-emitting devices according to the present embodiment, an electron source can be configured. By arranging a substrate having a phosphor and an anode electrode so as to be opposed to such an electron source, a flat panel display can be configured. The configurations of such a flat panel display and such a electron source are disclosed in Japanese Patent Application Laid-Open (JP-A) No. 2002-203475 and Japanese Patent Application Laid-Open No. 2005-190769 or the like, for example.

EXAMPLE 1

The surface conduction electron-emitting device having the conductive film 2 formed in a shape shown in FIG. 1 was manufactured. The manufacturing steps are as follows.

Step a: A quartz substrate ($SiO_2$ substrate) as the substrate 1 was sufficiently cleaned by an organic solvent. Then, the electrodes 3 and 4 made of Pt were formed on the substrate 1. An electrode gap d, a film thickness, the length of opposite sides of the electrodes 3 and 4 were defined to be 10 μm, 0.04 μm, and 200 μm, respectively (opposite sides of the electrodes 3 and 4 were defined to be parallel with each other).

Step b: A droplet of a solution having an organic metallic compound was dropped between the electrodes 3 and 4 of the substrate 1 by using an ink jet method. Then, by drying the dropped solution, an organic metallic thin film was formed. After that, by burning the organic metallic thin film by a clean oven, the conductive film 2 made of palladium oxide (PdO) particles was formed.

The shape of the conductive film 2 was as follows. L was 0, an angle θ2 (∠EAD) and an angle θ1 (∠FCE) on the side of the conductive film 2 at the point A or the point C shown in FIG. 1A were defined to be 135°, respectively. The width W of the conductive film 2 (refer to FIG. 3A) was defined to be 5 μm (constant) in a direction in parallel with opposite sides of the electrodes 3 and 4. The film thickness of this fine particle film was 0.004 μm.

Figure 16:
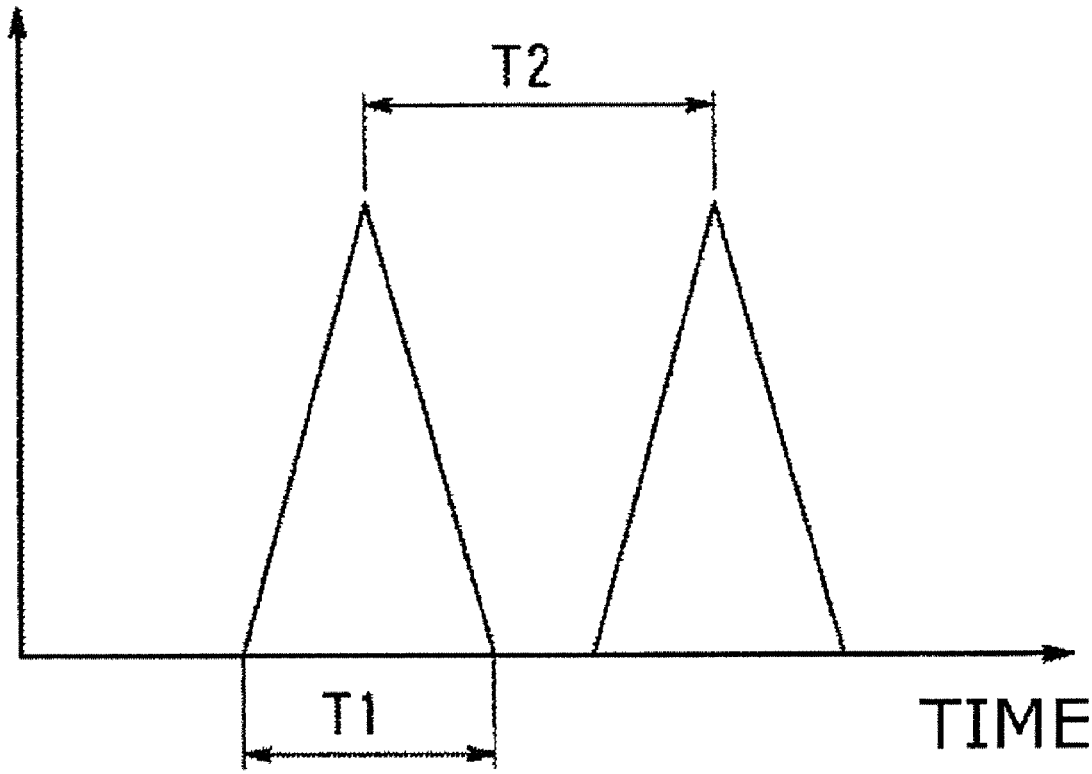
FIG. 16 is a view showing a forming voltage waveform, which is used in the example.

Step c: The substrate 1, on which the electrodes 3 and 4, and the conductive film 2 were formed, was mounted in the vacuum container 9 of the characteristic evaluation apparatus shown in FIG. 14. Then, by using an exhaust pump 15, the inside of the vacuum container 9 was exhausted till a degree of vacuum of the inside of the vacuum container 9 becomes about $10^{-4}$ Pa. After that, by applying the voltage between the electrodes 3 and 4 by means of the power source 11, the gap 5 was formed (the forming processing). The forming processing was carried out for about 60 sec with a voltage waveform shown in FIG. 16 (T1 was 1 msec, T2 was 10 msec, and a crest value of a triangle wave (a peak voltage upon the forming) was 10 V).

Subsequently, introducing benzonitrile in a vacuum atmosphere to maintain a degree of vacuum about $1\times10^{-4}$ Pa, the activation processing was carried out. The crest value was defined to be 15 V. The activation processing was ended when the device current If was saturated (about 30 min).

According to the present embodiment, an electron-emitting device having one piece of the conductive film 2 and an electron-emitting device having ten pieces of the conductive films 2 were manufactured, respectively. In the electron-emitting device having ten pieces of the conductive films 2, a gap G between the adjacent conductive films 2 was defined to be 5 μm.

An electron emission characteristic of a plurality of devices according to the present example, which was manufactured as described above, was measured by the above-described characteristic evaluation apparatus. A measurement condition was that a distance between the anode electrode 10 and the device was 2 mm, a potential of the anode electrode 10 was 10 kV, a device voltage Vf was 15 V, and a degree of vacuum in the vacuum container 9 when measuring the electron emission characteristic was $1\times10^{-6}$ Pa.

EXAMPLE 2

In the conductive film 2 according to the example 1, both of θ1 and θ2 were defined to be 150°, and others were the same as the example 1.

EXAMPLE 3

In the conductive film 2 according to the example 1, θ2 was defined to be 135°, and θ1 was defined to be 150° (a shape as shown in FIG. 19). Others were the same as the example 1.

EXAMPLE 4

Five pieces of the conductive films 2 with a width W=5 μm and five pieces of the conductive films 2 with a width W=10 Am were alternately arranged, respectively. Others were the same as the example 1.

COMPARATIVE EXAMPLE 1

Figure 17:
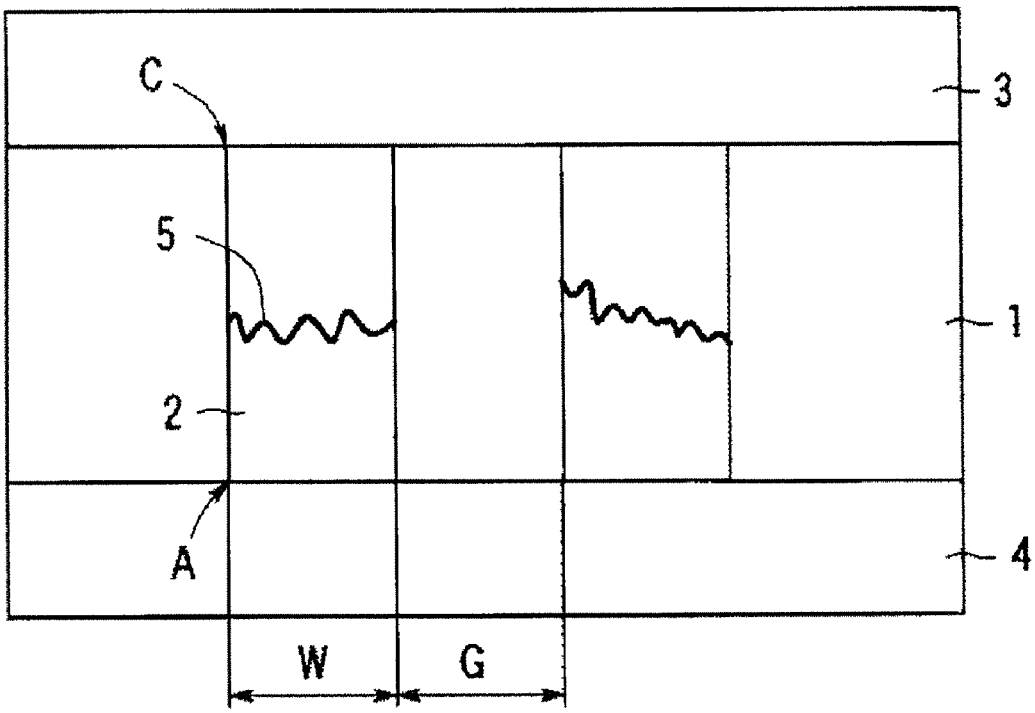
FIG. 17 is a plan pattern view showing a configuration of a device of a comparative example, which is made in the example.

The shape of the conductive film 2 was made into a shape without a bend portion as shown in FIG. 17. Others were the same as the example 1.

COMPARATIVE EXAMPLE 2

The shape of the conductive film 2 was made into a shape having a stenosis portion as shown in FIG. 2B. Others were the same as the example 1. A width W0 of the conductive film 2 at the stenosis portion was defined to be 5 μm, and a width (W3+W0+W3) at the connection portion of the conductive film 2 and the electrode 3 and the connection portion of the conductive film 2 and electrode 4 was defined to be 15 μm.

FIG. 19 shows the configuration of the device and a forming power of each example according to the present invention and each comparative example. In FIG. 19, "a space" represents a width shared by one piece or ten pieces of the conductive films (the length in a direction in parallel with opposite sides of the electrode), "a length of a gap" represents a length of a gap, which is formed on the conductive film, and "a formation position of the gap" represents a well control ability of the position where the gap is formed in each device. In these items, a double circle represents being easily controlled, a circle represents being easily controlled not so much as the example 1, and a cross represents a bad control ability. "L/W" was rounded off and was obtained as effective two digits. "A forming power" represents a power necessary for the forming processing defining the device of the example 1 being 1.

In addition, changing L in the conductive film according to the example 1, increase of temperature per 1 [W] for L/W was measured. A result thereof was shown in FIG. 18. As shown in FIG. 18, it was known that increase of temperature, which was equal to or higher than the comparative examples 1 and 2 being conventional example, was obtained in the case of $|L/W|\leqq0.8$. In other words, in the case of $|L/W|\leqq0.8$, it was known that the gap could be formed on the conductive film with a power consumption, which was lower than the conventional example.

EXAMPLE 5

By arranging many electron-emitting devices according to the example 1 on the glass substrate in matrix, and wiring each electron-emitting device so as to be capable of being driven individually, a electron source was manufactured. Then, arranging a face plate so as to be opposed to this electron source, a flat panel display (an image display apparatus) was manufactured. The face plate is provided with an illuminant layer and a metal back. The illuminant layer provided with a phosphor of RGB, and the metal back is used as an anode electrode. Driving this image display apparatus, a display image with a high uniformity could be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-224966, filed on Aug. 31, 2007, which is hereby incorporated by reference herein in their entirety.

What is claimed is:

1. A manufacturing method of an electron-emitting device comprising the steps of:

preparing a substrate having a first electrode and a second electrode, and a conductive film for connecting the first electrode and the second electrode; and forming a gap on the conductive film by applying a voltage between the first electrode and the second electrode;

wherein a planar shape of the conductive film has a V-shape portion between the first electrode and the second electrode, and wherein assuming that an inside apex of a bend portion of the V-shape portion is a point B, an outside apex of the bend portion is a point E, an intersecting point of a side of the conductive film including the point E and the first electrode is a point C, an intersecting point of the side of the conductive film including the point E and the second electrode is a point A, a distance between a line segment AC connecting the point A and the point C and the point B is L, and a width of the conductive film at a connection portion with one electrode of the first and second electrodes, which is at a higher potential than the other one of the electrodes in the step of forming the gap on the conductive film is W, $|L/W| \leqq 0.8$ is established.

2. A manufacturing method according to claim 1, wherein opposite sides of the first electrode and the second electrode are parallel with each other; and a width of the conductive film in a direction in parallel with these sides is constant between the first electrode and the second electrode.

3. A manufacturing method according to claim 1, wherein the substrate comprises a plurality of conductive films having the V-shape portions, respectively; and the V-shape portions of the plurality of conductive films are bent in the same direction.

* * * * *